US010168087B2

(12) United States Patent
Munk et al.

(10) Patent No.: US 10,168,087 B2
(45) Date of Patent: Jan. 1, 2019

(54) REFRIGERANT CHARGE MANAGEMENT IN AN INTEGRATED HEAT PUMP

(71) Applicant: UT-Battelle, LLC, Oak Ridge, TN (US)

(72) Inventors: Jeffrey D. Munk, Knoxville, TN (US); Moonis R. Ally, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 172 days.

(21) Appl. No.: 14/844,757

(22) Filed: Sep. 3, 2015

(65) Prior Publication Data

US 2017/0067676 A1 Mar. 9, 2017

(51) Int. Cl.

| | |
|---|---|
| ***F25B 45/00*** | (2006.01) |
| ***F25B 5/02*** | (2006.01) |
| ***F25B 41/00*** | (2006.01) |
| ***F25B 41/04*** | (2006.01) |
| *F25B 13/00* | (2006.01) |

(52) U.S. Cl.

CPC ..... *F25B 45/00* (2013.01); *F25B 5/02* (2013.01); *F25B 41/003* (2013.01); *F25B 41/04* (2013.01); *F25B 13/00* (2013.01); *F25B 2313/021* (2013.01); *F25B 2313/02741* (2013.01); *F25B 2339/047* (2013.01); *F25B 2400/0409* (2013.01); *F25B 2400/0411* (2013.01); *F25B 2400/19* (2013.01); *F25B 2600/05* (2013.01); *F25B 2600/2501* (2013.01)

(58) Field of Classification Search

CPC .... F25B 45/00; F25B 13/00; F25B 2345/006; F25B 2600/2515; F25B 41/04; F25B 41/046; F25B 2313/003

USPC ..... 62/77

See application file for complete search history.

(56) References Cited

U.S. PATENT DOCUMENTS

| | | | | |
|---|---|---|---|---|
| 4,299,098 | A * | 11/1981 | Derosier | F24D 11/0214 62/238.6 |
| 5,653,120 | A * | 8/1997 | Meyer | F24D 15/04 62/324.4 |
| 8,056,348 | B2 * | 11/2011 | Murakami | F25B 13/00 62/149 |
| 9,383,126 | B2 * | 7/2016 | Chen | F25B 29/003 |
| 2014/0245770 | A1 * | 9/2014 | Chen | F25B 29/003 62/238.7 |
| 2014/0345310 | A1 * | 11/2014 | Tamaki | F25B 13/00 62/238.6 |

FOREIGN PATENT DOCUMENTS

| | | |
|---|---|---|
| WO | 2013/096269 | 6/2013 |

* cited by examiner

*Primary Examiner* — Frantz Jules
*Assistant Examiner* — Martha Tadesse
(74) *Attorney, Agent, or Firm* — Warner Norcross + Judd LLP

(57) ABSTRACT

A heat pump including an integrated system for the management of refrigerant charge is provided. The heat pump includes an indoor line and an outdoor line that are connected to a compressor through a reversing valve. Refrigerant charge is managed by coupling the inactive line to the suction side of the compressor. For example, the heat pump can include an expansion valve to couple the inactive line to the compressor to supplement the flow-rate of refrigerant. The heat pump is operable in a dedicated water heating mode and a space cooling and water heating mode in some embodiments, while other modes of operation are contemplated in other embodiments.

13 Claims, 3 Drawing Sheets

REFRIGERANT CHARGE MANAGEMENT IN AN INTEGRATED HEAT PUMP

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

BACKGROUND OF THE INVENTION

The present invention relates to heat pumps and, in particular, the management of refrigerant charge in heat pumps.

Heat pumps provide thermal energy from a heat source to a heat sink, moving thermal energy opposite to the direction it would normally flow. Heat pumps can be used to provide indoor cooling, for example, expelling heat from an indoor area into an outdoor environment. Heat pumps can also be used to heat a water supply, drawing heat from the outdoor or indoor environments. Heat pumps often offer lower heating costs, air conditioning costs, and hot water preparation costs among existing technologies, and are gaining increased acceptance in the marketplace.

Heat pumps may include two or more modes of operation. For example, a heat pump might operate in a space cooling mode and may operate in a water heating mode. An appropriate amount of refrigerant charge in one mode may be insufficient for the amount of refrigerant needed in another mode. For example, liquid refrigerant can accumulate in a space cooling heat exchanger, reducing the liquid refrigerant otherwise available for water heating.

Excess refrigerant during transient operation or periods of low evaporator heat load can be stored in an accumulator upstream of a compressor. An accumulator can prevent damage to the compressor caused by liquid compression and oil dilution. However, it remains desirable to improve the management of refrigerant charge for heat pumps, and in particular heat pumps having multiple modes of operation.

SUMMARY OF THE INVENTION

A heat pump including an integrated system for the management of refrigerant charge is provided. The heat pump includes an indoor line and an outdoor line that are selectively connected to a compressor through a reversing valve. Refrigerant charge is managed by use of the inactive heat exchanger's electronic expansion valve to reduce active charge and by coupling the inactive line to the suction side of the compressor to increase active charge by use of a charge adjustment valve. The heat pump is operable in a dedicated water heating mode and a space cooling and water heating mode, while other modes of operation are contemplated in other embodiments. Accordingly, embodiments of the present invention provides a method to remove refrigerant charge from the inactive line to the line loop, and vice versa, in order to achieve the appropriate refrigerant charge level to optimize the efficiency of the integrated heat pump in the operational modes described.

In one embodiment, the heat pump includes a compressor, a water heat exchanger, an indoor line, an outdoor line, a four-way reversing valve, and an expansion valve. The compressor provides refrigerant vapor to the water heat exchanger in both modes of operation: dedicated water heating mode and spacing cooling and water heating mode. The indoor line includes an indoor heat exchanger, and the outdoor line includes an outdoor heat exchanger. The reversing valve selectively couples either of the indoor line or the outdoor line with the compressor, which then provides high pressure refrigerant gas to the water heat exchanger. When the refrigerant in the active line falls below a threshold level, the charge adjustment valve couples the inactive line to the active line to supplement the flow-rate of refrigerant to the compressor.

In the dedicated water heating mode, the four-way reversing valve is placed in a first position to direct low pressure refrigerant gas from the outdoor heat exchanger to the compressor. High pressure refrigerant gas from the compressor is directed to the water heat exchanger, where the refrigerant gas is condensed and heat is transferred to a domestic water supply. The resulting condensed refrigerant is directed to the outdoor expansion valve and outdoor heat exchanger. Here, the condensed refrigerant is expanded and vaporized and absorbs heat from an outdoor heat sink at the outdoor heat exchanger. The indoor line is isolated from the active refrigerant circuits by closing the indoor expansion valve and closing the vapor valve. If the active refrigerant charge is low, the charge adjustment valve temporarily opens coupling the inactive indoor line to the suction side of the compressor, thereby transferring idle refrigerant from the inactive indoor line to the active refrigerant circuit. If the active refrigerant charge is higher than the desired value, the indoor expansion valve is temporarily opened to release refrigerant into the inactive indoor line.

In the space cooling and water heating mode, the four-way refrigerant valve is placed in a second position to direct low pressure refrigerant gas from the indoor heat exchanger to the compressor suction line. High pressure refrigerant gas from the compressor is directed to the water heat exchanger, where the refrigerant gas is condensed and heat is transferred to a domestic water supply. The resulting condensed refrigerant is directed to the indoor expansion valve and indoor heat exchanger. Here, the condensed refrigerant is expanded and evaporated by heat exchange with the space to be cooled. The outdoor line is isolated from the active refrigerant circuit by closing the outdoor expansion valve and closing the vapor valve. If the active refrigerant charge is low, the charge adjustment valve temporarily opens coupling the inactive outdoor line to the suction side of the compressor, thereby transferring idle refrigerant from the inactive outdoor line to the active indoor line. If the active refrigerant charge is higher than the desired value, the outdoor expansion valve is temporarily opened to release refrigerant into the inactive outdoor line.

Accordingly, embodiments of the present invention allow the active refrigerant charge in an integrated heat pump to be optimized in multiple modes of operation. With improved control over the refrigerant charge level, the heat pump can operate under more extreme conditions before reaching the operating limits of the compressor. The refrigerant charge can also be adjusted in order to achieve optimal efficiency.

These and other features and advantages of the present invention will become apparent from the following description of the invention, when viewed in accordance with the accompanying drawings and appended claims.

DETAILED DESCRIPTION OF THE CURRENT EMBODIMENTS

The current embodiments relate to a heat pump including an integrated system for the management of refrigerant charge. Refrigerant charge is managed across multiple modes of operation by directing idle refrigerant in an inactive line to the suction side of a compressor and by venting excess refrigerant from the active line into the inactive line. The multiple modes of operation can include a dedicated water heating mode and a space cooling and water heating mode in some embodiments, while other modes of operation are contemplated in other embodiments.

Figure 1:
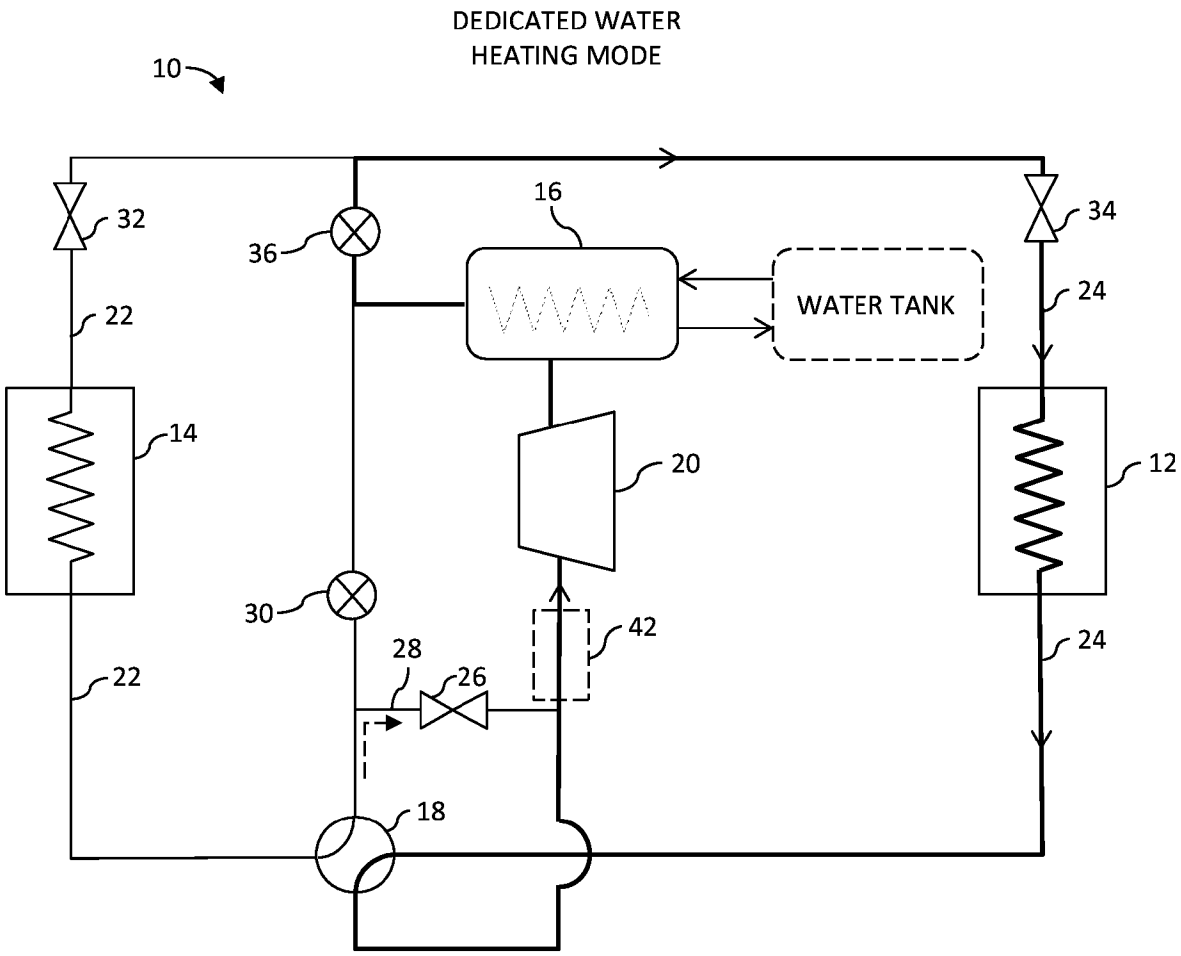
FIG. 1 is a schematic diagram of a heat pump in accordance with a current embodiment, indicating operation in a dedicated water heating mode.
Figure 2:
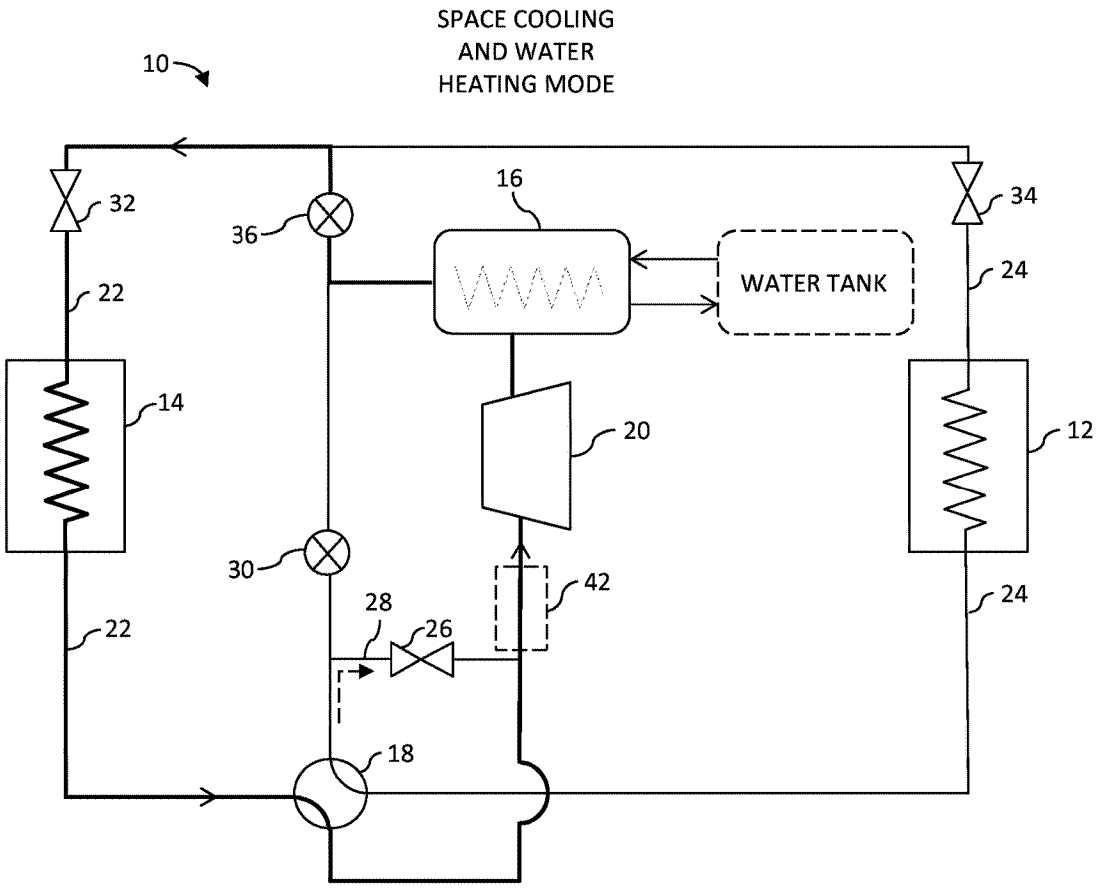
FIG. 2 is a schematic diagram of the heat pump of FIG. 1, indicating operation in a space cooling and water heating mode.

Referring now to FIGS. 1-2, a heat pump in accordance with one embodiment is illustrated and generally designated 10. The heat pump 10 includes an outdoor heat exchanger 12, an indoor heat exchanger 14, and a desuperheater or water heat exchanger 16 that transfers heat from the refrigerant to water (e.g., domestic hot water). The heat pump 10 also includes a reversing valve 18 to selectively couple the outdoor or indoor heat exchangers 12, 14 to a compressor 20. An indoor line 22 couples the low pressure side of the indoor heat exchanger 14 to the reversing valve 18, and an outdoor line 24 couples to the low pressure side of the outdoor heat exchanger 12 to the reversing valve 18. A charge adjustment valve 26 couples an output of the reversing valve 18 to the suction side of the compressor 20. The charge adjustment valve 26 is located along an auxiliary line 28 from the reversing valve 18. The heat pump 10 additionally includes a vapor valve 30, an indoor expansion valve 32, and an outdoor expansion valve 34, and a full condensing valve 36.

As recited herein, the terms "indoor line" and "outdoor line" include any enclosed passageway through which refrigerant flows or can flow. The indoor line 22 can be indoors but can also be outdoors, and the outdoor line 24 can be outdoors but can also be indoors. The indoor line 22 includes the indoor heat exchanger 14 in the illustrated embodiment, and the outdoor line 24 includes the outdoor heat exchanger 12 in the illustrated embodiment.

The heat exchangers 12, 14 can include any construction adapted to transfer heat between a first medium and a second medium. In one embodiment, the heat exchangers 12, 14 can include a fin-and-tube construction for the transfer of heat between refrigerant and air. For example, the heat exchangers 12, 14 can include an internal fan to direct the flow of air over a fin-and-tube construction. The outdoor heat exchanger 12 is not necessarily outdoors, and can exchange heat with a heat source/sink other than outdoor air, which may be located indoors or outdoors. The indoor heat exchanger 14 is not necessarily indoors, and can exchange heat with a heat source/sink other than indoor air, which may be located indoors or outdoors. Examples of a heat source/sink include the ground, soil, sand, rock, ground water, or surface water.

The water heat exchanger 16 can include any construction to directly or indirectly heat a liquid. For example, the water heat exchanger 16 can include a tube-in-tube construction such that refrigerant flowing within an inner tube can transfer heat to water flowing within an outer tube surrounding the refrigerant carrying tube. A separate pump (not shown) can control the flow of water through the outer tube, thereby managing the transfer of heat from the water heat exchanger 16 to the supply of water. The pump can be a single speed pump in some embodiments, and can include a variable speed pump in other embodiments. The water supply (e.g., storage tank or water heater) can include a supplemental source of heat, for example an electrical resistance heater or a gas heater.

The reversing valve 18 can include any construction adapted to selectively control the flow of refrigerant between two input ports and two output ports. In the illustrated embodiment, the reversing valve 18 is a two-position four-way valve. In the first position, the four-way reversing valve 18 couples the outdoor heat exchanger 12 to the compressor 20. The four-way reversing valve 18 simultaneously couples the indoor heat exchanger 14 to the vapor valve 30 and the charge adjustment valve 26. In the second position, the four-way reversing valve 18 couples the indoor heat exchanger 14 to the compressor 20. The four-way reversing valve 18 simultaneously couples the outdoor heat exchanger 12 to the vapor valve 30 and the charge adjustment valve 26. Consequently, the reversing valve 18 allows the outdoor heat exchanger 12 to be either connected in series with the water heat exchanger 16 or isolated from the water heat exchanger 16. Similarly, the reversing valve 18 allows the indoor heat exchanger 14 to be either connected in series with the water heat exchanger 16 or isolated from the water heat exchanger 16. The reversing valve 18 is a single valve in the illustrated embodiment, but can include multiple valves in other embodiments. The full condensing valve 36 and vapor valve 30 are operated in tandem with one always being open and one always being closed. These valves are used to control whether the indoor heat exchanger 14 or outdoor heat exchanger 12 are isolated. If the full condensing valve 36 is closed and the vapor valve 30 is open, then all heat exchangers have refrigerant flow and there are no inactive lines. Conversely, if the full condensing valve 36 is open and the vapor valve 30 is closed, then the position of reversing valve 18 along with the closing of the either indoor expansion valve 32 or outdoor expansion valve 34 determines whether the indoor heat exchanger 14 or outdoor heat exchanger 12 is isolated and inactive. Indoor expansion valve 32 and outdoor expansion valve 34 are capable of closing completely in addition to adjusting their opening to meter refrigerant. In addition, flow in the opposite (non-metered) direction is allowed by an incorporated check valve. In this embodiment the indoor expansion valve 32 and outdoor expansion valve 34 are electronically controlled expansion valves, but can include separate valves. In still other embodiments, the indoor expansion valve 32 and outdoor expansion valve 34 can be replaced with a solenoid valve, check valve, and fixed orifice, capillary tube, or thermostatically controlled expansion valve, or any other similar device. The charge adjustment valve 26 can selectively couple the inactive refrigerant line to the compressor suction line in order to increase the active refrigerant charge. In this embodiment the charge adjustment valve 26 is an electronically controlled expansion valve, but can include other valve types. In still other embodiments, the charge adjustment valve 26 can be replaced with a solenoid valve with or without the additional use of an orifice or capillary tube.

Referring now to FIG. 1, the heat pump 10 is illustrated in a first mode where the heat pump is operative for heating a liquid, for example domestic hot water. In this mode of operation, the reversing valve 18 assumes the first position so as to direct low pressure refrigerant gas from the outdoor heat exchanger 12 to the compressor 20. High pressure refrigerant gas from the compressor 20 is directed to the water heat exchanger 16, where the refrigerant gas is condensed and heat is transferred to a domestic water supply. The resulting condensed refrigerant is directed to the outdoor heat exchanger 12 while the vapor valve 30 remains closed and the full condensing valve 36 remains open. The condensed refrigerant is vaporized at the outdoor heat exchanger 12 and absorbs heat from an outdoor heat sink. If the refrigerant in the active (outdoor) line falls sufficiently below the desired level (e.g., less than a minimum threshold for this mode of operation), the charge adjustment valve 26 selectively couples the inactive (indoor) line 22 to the suction side of the compressor 20, thereby transferring idle refrigerant from the inactive (indoor) line 22 to the active (outdoor) line 24. If the active refrigerant charge is sufficiently higher than the desired valve (e.g., greater than a maximum threshold for this mode of operation), the indoor expansion valve 32 is opened to release refrigerant into the inactive (indoor) line 22 while the charge adjustment valve 26 remains closed.

Referring now to FIG. 2, the heat pump 10 is illustrated in a second mode where the heat pump is operative for heating a liquid, for example domestic hot water, and cooling a space (e.g., within a building). In this mode of operation, the reversing valve 18 assumes the second position so as to direct low pressure refrigerant gas from the indoor heat exchanger 14 to the compressor 20. High pressure refrigerant gas from the compressor 20 is directed to the water heat exchanger 16, where the refrigerant gas is condensed and heat is transferred to a domestic water supply. The resulting condensed refrigerant is directed to the indoor heat exchanger 14, while the vapor valve 30 remains closed and the full condensing valve 36 remains open. The condensed refrigerant is evaporated by heat exchange with the space to be cooled. If the refrigerant in the active (indoor) line 22 falls sufficiently below the desired level (e.g., less than a minimum threshold for this mode of operation), the charge adjustment valve 26 selectively couples the inactive (outdoor) line 24 to the suction side of the compressor 20, thereby transferring idle refrigerant from the inactive (outdoor) line 24 to the active (indoor) line 22. If the active refrigerant charge is sufficiently higher than the desired valve (e.g., greater than a maximum threshold for this mode of operation), the outdoor expansion valve 34 is opened temporarily to release sufficient refrigerant into the inactive (outdoor) line 24 while the charge adjustment valve 26 remains closed.

The heat pump 10 is therefore operable in multiple distinct modes, and the refrigerant is managed such that the charge is neither insufficient nor excessive. The heat pump 10 is also operable in a space cooling mode and space heating mode, optionally with the inclusion of an accumulator 42 to protect the compressor from liquid refrigerant. The heat pump 10 can also include a digital controller (not shown) that includes computer readable instructions that, when executed, cause the digital controller to manage the refrigerant charge in the desired operating mode. The digital controller can control, for example, actuation of the full condenser valve 36, the indoor expansion valve 32, the outdoor expansion valve 34, the vapor valve 30, the charge adjustment valve 26, the compressor 20, and any fans or accumulators associated with the heat exchangers 12, 14. The digital controller can be wired to various components of the heat pump 10 when the heat pump 10 is installed, for example, with control wiring, power wiring, or both. The digital controller can also include connections to various sensors for determining the level of charge in the active and idle lines, as well as the position of the various valves, optionally in the performance of the below method.

In another embodiment, a method for managing refrigerant charge in a heat pump is provided. The method generally includes: (a) selecting a first position or a second position for a reversing valve; (b) operating a compressor to direct the flow of refrigerant from an active line to a water heat exchanger; (c) determining whether the charge in the active line is within predetermined tolerances (optionally a finite range); (d) coupling the inactive line to the suction side of the compressor if the active charge is less than a desired value; and (e) venting the active line to the inactive line if the active charge is greater than a desired value.

Figure 3:
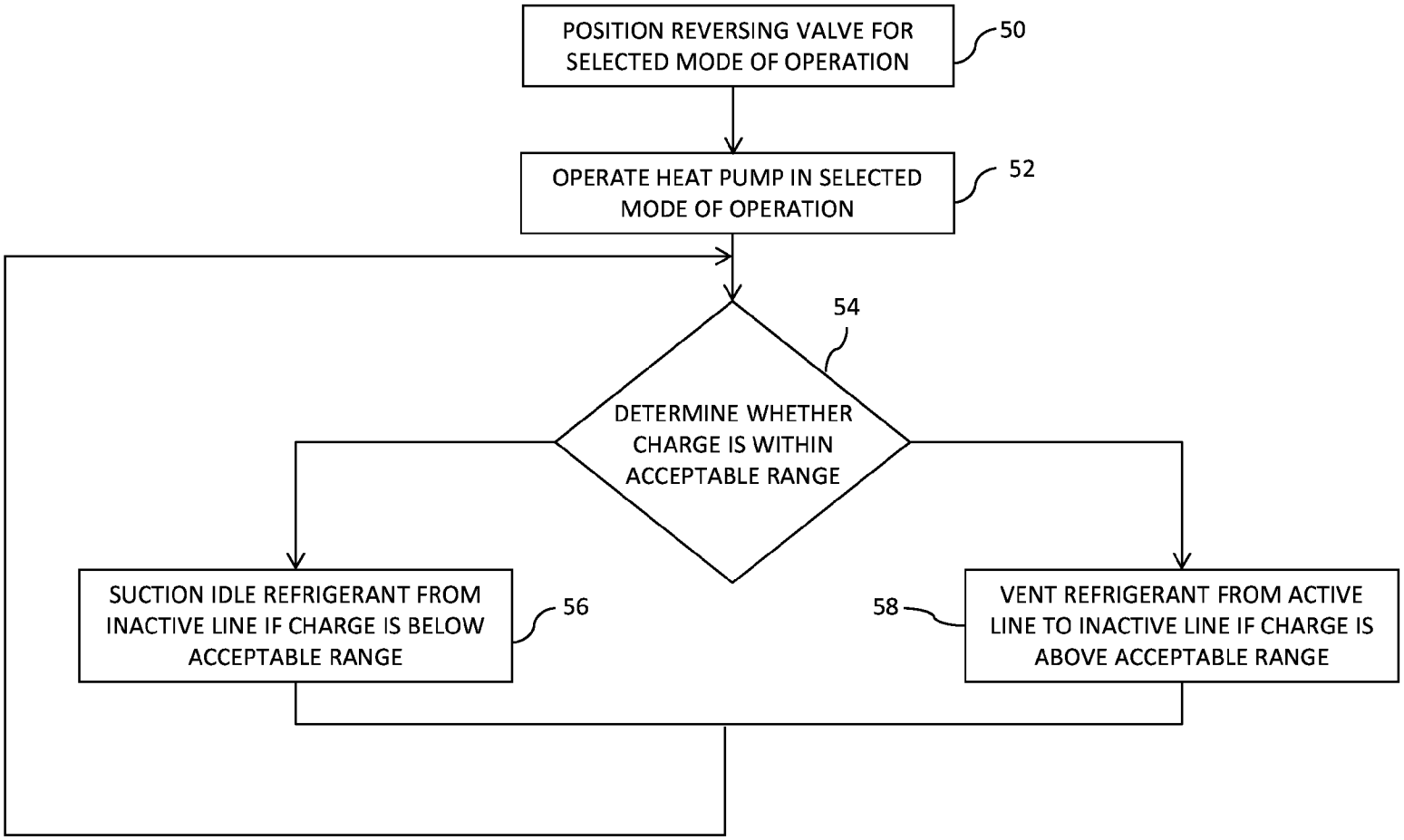
FIG. 3 is a flow-chart illustrating operation of the heat pump of FIGS. 1-2 in a dedicated water heating mode and a space cooling and water heating mode.

The step of selecting a first position or a second position is illustrated as step 50 in FIG. 3. This step generally includes selecting the outdoor line or the indoor line as the active line, while the non-selected line is the idle line. In the first position, the reversing valve 18 directs low pressure refrigerant gas from the outdoor heat exchanger 12 to the compressor 20. The reversing valve 18 simultaneously couples the indoor heat exchanger 14 to the charge adjustment valve 26. In the second position, the reversing valve 18 directs low pressure refrigerant gas from the indoor heat exchanger 14 to the compressor 20. The reversing valve 18 simultaneously couples the outdoor heat exchanger 12 to the charge adjustment valve 26.

The step of operating a compressor is illustrated as step 52 in FIG. 3. This step generally includes compressing low pressure refrigerant gas from the active line for output to the water heat exchanger 16. The water heat exchanger 16 then heats a liquid (e.g., domestic water) using compressed refrigerant gas from the compressor 20. The domestic water (e.g., a storage tank or a water heater) can include a supplemental source of heat, for example an electrical resistance heater or a gas or oil heater. The vapor valve 30 remains closed during operation of the compressor 20.

The step of determining whether the charge in the active line is within predetermined tolerances is illustrated as step 54 in FIG. 3. This step generally includes determining whether the refrigerant charge in the active line ("active charge") is between a minimum threshold value and a maximum threshold value. This step can further include measuring the quantity of charge in the active line directly, or measuring a parameter affected by the quantity of charge in the active line. The measured parameter can include the refrigerant subcooling temperature, the compressor discharge temperature, or the compressor discharge pressure. If the active charge is determined to be less than the minimum threshold value, the active charge in the active line is determined to be insufficient, and the method proceeds to step 56. If the active charge is determined to be greater than the minimum threshold value, the active refrigerant charge is determined to be excessive, and the method proceeds to step 58. In some embodiment, the minimum and maximum threshold values can be the same value, effectively a reference value in a closed feedback loop. In addition, the minimum and maximum threshold values can be different depending on the mode of operation, such that in the first mode (dedicated water heating) there is a first minimum threshold value and first maximum threshold value, and in the second mode (space cooling and water heating) there is a second minimum threshold value and second maximum threshold value.

The step of coupling the inactive line to the suction side of the compressor 20 is illustrated as step 56 in FIG. 3. This step generally includes selectively opening a metering device to control the amount refrigerant moving therethrough, such that the metering device provides a plurality of flow-rates therethrough. The metering device includes a charge adjustment valve 26 in the illustrated embodiment. The charge adjustment valve 26 is an electronic expansion valve in some embodiments, while in other embodiments the charge adjustment valve is a thermal expansion valve. In other embodiments, the charge adjustment valve 26 includes multiple valves. For example, a first valve (e.g., electronic) is provided in series with a second valve (e.g., non-electronic). The charge adjustment valve 26 is located along an auxiliary line 28 upstream of the compressor 20. Refrigerant is drawn through the metering device into the active line due to the pressure differential.

The step of venting the active line to the inactive line is illustrated as step 58 in FIG. 3. This step generally includes closing the charge adjustment valve 26 and opening the expansion valve 32, 34 in the idle line. Refrigerant is then released into the inactive heat exchanger 12, 14 due to the pressure differential between the high pressure output of the water heat exchanger 16 and the idle heat exchanger 12, 14. When the desired refrigerant charge is achieved, the idle expansion valve is closed and the method returns to step 54.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A heat pump comprising:

a compressor configured to compress a refrigerant;

a water heat exchanger to receive the refrigerant from the compressor for heating a supply of water;

an indoor expansion valve to receive the refrigerant in liquid form from the water heat exchanger;

an indoor heat exchanger to receive the refrigerant in liquid form from the indoor expansion valve and to output the refrigerant in gas form to the compressor;

an outdoor expansion valve to receive the refrigerant in liquid form from the water heat exchanger;

an outdoor heat exchanger to receive the refrigerant in liquid form from the outdoor expansion valve and to output the refrigerant in gas form to the compressor;

a reversing valve in fluid communication with the indoor heat exchanger and the outdoor heat exchanger, wherein the reversing valve selectively couples the indoor heat exchanger or the outdoor heat exchanger to the compressor as an active heat exchanger; and a charge adjustment valve to selectively couple the indoor heat exchanger or the outdoor heat exchanger to the compressor as an inactive heat exchanger, such that the indoor heat exchanger is the active heat exchanger when the reversing valve couples the indoor heat exchanger to the compressor while the outdoor heat exchanger is simultaneously coupled to the charge adjustment valve as the inactive heat exchanger, and such that the outdoor heat exchanger is the active heat exchanger when the reversing valve couples the outdoor heat exchanger to the compressor while the indoor heat exchanger is simultaneously coupled to the charge adjustment valve as the inactive heat exchanger, wherein the charge adjustment valve is coupled along an auxiliary line between an output of the inactive heat exchanger and an input of the compressor, such that the refrigerant in gas form from the inactive heat exchanger is provided through the auxiliary line to the input of the compressor in response to a level of the refrigerant moving through the compressor being below a threshold level.

2. The heat pump of claim 1 wherein the charge adjustment valve is an electronically controlled expansion valve, a thermal expansion valve, a solenoid valve, or a capillary tube.

3. The heat pump of claim 1 wherein the reversing valve is a two-position four-way reversing valve.

4. The heat pump of claim 3 wherein the heat pump operates in a dedicated water heating mode when the reversing valve is in a first position, and wherein the heat pump operates in a space cooling and water heating mode when the reversing valve is in a second position.

5. The heat pump of claim 4 wherein the threshold level is dependent on a mode of operation.

6. The heat pump of claim 5 wherein the threshold level includes a first minimum charge for the dedicated water heating mode and a second minimum charge for the space cooling and water heating mode, the first and second minimum charges being different from each other.

7. A heat pump comprising:

a compressor operable to compress a refrigerant;

a water heat exchanger operable to receive the refrigerant from the compressor for heating a supply of water;

an indoor line including an indoor expansion valve to receive the refrigerant in liquid form from the water heat exchanger and an indoor heat exchanger to receive the refrigerant in liquid form from the indoor expansion valve and output the refrigerant in gas form to the compressor;

an outdoor line including an outdoor expansion valve to receive the refrigerant in liquid form from the water heat exchanger and an outdoor heat exchanger to receive the refrigerant in liquid form from the outdoor expansion valve and output the refrigerant in gas form to the compressor;

a reversing valve and a charge adjustment valve in fluid communication with the indoor line and the outdoor line;

wherein the reversing valve is operable to selectively couple the indoor line or the outdoor line to the compressor as an active line, the other of the indoor line or the outdoor line being an idle line; and wherein the charge adjustment valve is operable to selectively couple the idle line to the active line to manage the refrigerant in the active line, the charge adjustment valve being coupled along an auxiliary line between an output of the outdoor heat exchanger and an input of the compressor when the outdoor line is the idle line, the charge adjustment valve being coupled along the auxiliary line between an output of the indoor heat exchanger and the input of the compressor when the indoor line is the idle line, such that the refrigerant in gas form from the idle line is provided through the auxiliary line to the input of the compressor in response to a level of refrigerant moving through the active line being below a threshold level.

8. The heat pump of claim 7 wherein the charge adjustment valve is an electronically controlled expansion valve, a thermal expansion valve, a solenoid valve, or a capillary tube.

9. The heat pump of claim 7 wherein the reversing valve is a two-position four-way reversing valve.

10. The heat pump of claim 9 wherein the heat pump operates in a dedicated water heating mode when the reversing valve is in a first position, and wherein the heat pump operates in a space cooling and water heating mode when the reversing valve is in a second position.

11. The heat pump of claim 10 wherein the threshold level is dependent on a mode of operation.

12. The heat pump of claim 11 wherein the threshold level includes a first minimum charge for the dedicated water heating mode and a second minimum charge for the space cooling and water heating mode, the first and second minimum charges being different from each other.

13. The heat pump of claim 7 further including an indoor expansion valve and an outdoor expansion valve to selectively vent the refrigerant into the idle line.

* * * * *